US007568932B2

(12) United States Patent
O'Connor

(10) Patent No.: US 7,568,932 B2
(45) Date of Patent: Aug. 4, 2009

(54) ELECTRONIC CONNECTOR AND METHOD OF ATTACHMENT

(75) Inventor: Kurt F. O'Connor, Carmel, IN (US)

(73) Assignee: Delphi Technologies, Inc., Troy, MI (US)

( * ) Notice: Subject to any disclaimer, the term of this patent is extended or adjusted under 35 U.S.C. 154(b) by 94 days.

(21) Appl. No.: 11/506,336

(22) Filed: Aug. 18, 2006

(65) Prior Publication Data

US 2008/0045065 A1 Feb. 21, 2008

(51) Int. Cl.
*H01R 13/52* (2006.01)

(52) U.S. Cl. ..... 439/271

(58) Field of Classification Search ..... 439/271, 439/876, 67, 696

See application file for complete search history.

(56) References Cited

U.S. PATENT DOCUMENTS 4,213,004 A 7/1980 Acker et al.
6,017,238 A * 1/2000 Johnston ..... 439/404
6,533,620 B2 * 3/2003 Franzen et al. ..... 439/876
6,919,529 B2 * 7/2005 Franzen et al. ..... 219/121.64
2002/0046864 A1 4/2002 Bellino et al.
2003/0114022 A1 * 6/2003 Franzen et al. ..... 439/67

FOREIGN PATENT DOCUMENTS

WO 02058954 8/2002
WO 2005/091364 9/2005

OTHER PUBLICATIONS

EP Search Report Dated Nov. 7, 2007.

* cited by examiner

*Primary Examiner*—Jean F Duverne
(74) *Attorney, Agent, or Firm*—Jimmy L. Funke

(57) ABSTRACT

An electrical connector capable of being sealingly connected to a housing structure by using a friction stir welding technique includes a polymeric electrical connector harness, at least one electrical conductor extending through the electrical connector harness, and a welding strip sealingly connected around a perimeter of the electrical connector harness to facilitate welding of the electrical connector to a housing structure, such as a sealed metal housing, to sealingly close an opening defined in the housing structure. The electrical connector can be used in a process that creates a hermetic seal between the connector and the housing structure, eliminates the need for mechanical fasteners and/or adhesives, and/or reduces capital equipment and energy costs.

10 Claims, 2 Drawing Sheets

ELECTRONIC CONNECTOR AND METHOD OF ATTACHMENT

TECHNICAL FIELD

This invention relates to electrical connectors and more particularly to sealing attachment of an electrical connector to a metal structure.

BACKGROUND OF THE INVENTION

In many applications it is necessary or at least desirable to protect electrical components from damage due to contact with water, snow or the like. Examples include various electronic devices used in automotive applications, which are mounted on the vehicle in a location exterior of the vehicle cabin, such as under an automobile hood. In such cases, it is necessary or highly desirable that the electronic components are encased in a sealed housing. In such cases, it is often desirable to seal the electronic component in a metal housing. It is also typically necessary to provide electrical connections to the sealed electronic device. This is usually done by sealing the edges of a dielectric or electrically insulative (typically plastic) electrical connector harness to the periphery of an opening in the housing using a polymeric adhesive sealant.

It is often difficult to establish a reliable seal using adhesive sealants. In order to optimize reliability of an adhesive seal, it is necessary to decontaminate the bonding surfaces and maintain a clean environment throughout the assembly process. It is also desirable to maintain and control adhesive applicator equipment so as to ensure complete and uniform application of the adhesive sealant along the bonding surfaces. In some cases, it is also necessary to use mechanical fasteners, such as screws, to properly hold the connector in place. It is also typically necessary to thoroughly cure the adhesive sealant, typically for at least an hour in an oven, in order to establish a satisfactory seal between the housing and the connector. Thus, establishment of a reliable seal between a metal housing and an electrical connector using a conventional adhesive sealant requires meticulous care, a substantial investment in processing facilities, a substantial amount of time for processing, and, in some cases, mechanical fasteners which add to the manufacturing cost, without adding perceivable value.

SUMMARY OF THE INVENTION

Various aspects of the invention, either individually or in combination, overcome one or more of the aforementioned problems with known electrical connectors and processes for attaching electrical connectors to metal structures.

In accordance with one aspect of the invention, there is provided an electrical connector including a polymeric connector harness, at least one electrical conductor extending through the polymeric connector harness, and a welding strip sealingly connected around a perimeter of the polymeric connector harness to facilitate welding of the electrical connector to a housing structure to sealingly cover or fill an opening defined in the housing structure.

In accordance with another aspect of the invention there is provided an assembly including a housing structure defining an opening sealingly closed with an electrical connector. The electrical connector includes a polymeric connector harness, at least one electrical conductor extending through the polymeric connector harness, and a welding strip sealingly connected to and extending around a perimeter of the polymeric connector harness. A weld joint between the housing structure and the welding strip extends around the electrical connector to seal the electrical connector in the opening.

In accordance with another aspect of the invention, a process for sealingly attaching an electrical connector to a housing structure is provided. The process includes providing an electrical connector including a polymeric connector harness, at least one electrical conductor extending through the polymeric connector harness, and a welding strip sealingly connected to and extending around a perimeter of the polymeric connector harness, positioning the electrical connector at an opening defined in a housing structure, and welding the welding strip to the housing structure to sealingly attach the electrical connector at the opening of the housing structure.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figures 1, 2:
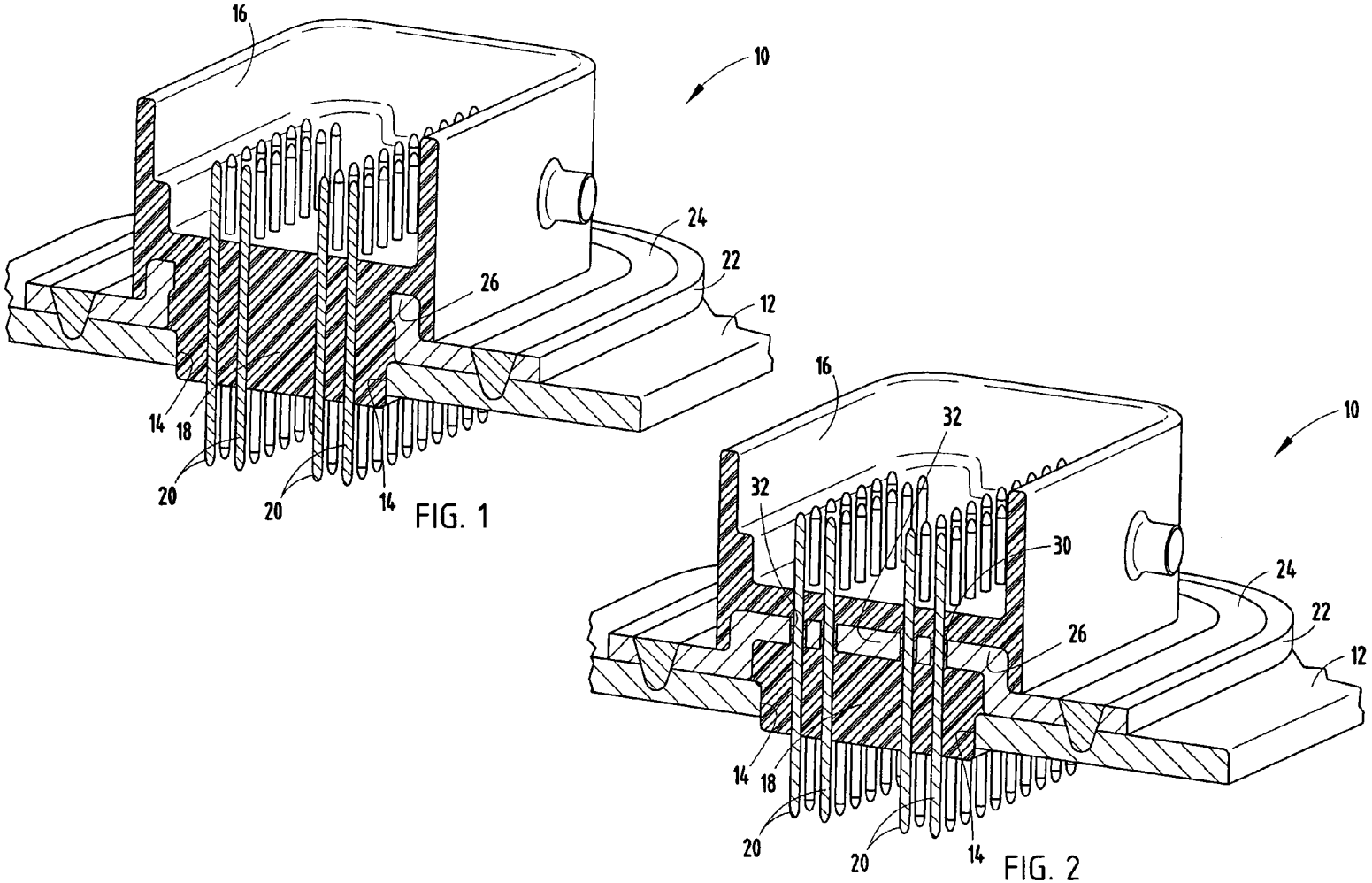
FIG. 1 is a cross-sectional perspective view of an electrical connector in accordance with the invention welded to a housing structure to sealingly close an opening in the housing structure.
FIG. 2 is a cross-sectional perspective view of an alternative embodiment of an electrical connector in accordance with the invention welded to a housing structure to sealingly close an opening defined in the housing structure, in which a welding strip is embedded within and extends substantially across an area of the polymeric electrical connector harness to provide electromagnetic impulse shielding.

Shown in FIG. 1 is an assembly 10 including a housing structure 12, such as the bottom, top or sidewall of an enclosure or housing for an electrical or electronic component, and an electrical connector 16 sealingly closing an opening in housing structure 12 defined by edges 14. Connector 16 includes a polymeric connector harness 18, a plurality of electrical conductors 20 extending through polymeric connector harness 18, and a welding strip 22 sealingly connected to polymeric connector harness 18.

Polymeric connector harness 18 can be molded or otherwise shaped from any of a variety of electrically insulative polymeric compositions comprising a thermoplastic polymer, such as a polyolefin (e.g., polypropylene), nylon, or the like, and optionally comprising non-polymeric additives, such as fillers, colorants, UV stabilizers, etc. Welding strip 22 can be a metal strip sealingly connected to polymeric connector harness 18 by embedding or insert-molding a portion, such as upstanding lip section 26 within polymeric connector harness 18. Alternatively, welding strip 22 may be a thermoplastic strip that is capable of being friction strip welded. In the case of a thermoplastic welding strip 22, it can either be a separate component insert molded into connector 16, or an integral portion of connector 16 that is formed together with connector 16 in a single molding operation. Electrical conductors 20 can be embedded within polymeric connector harness 18 during an insert-molding process. Sizing agents (e.g., silane adhesion promoters such as aminopropyltrimethoxysilane) may be employed to promote adhesion and sealing engagement between polymeric connector harness 18 and the embedded portions of welding strip 22 and electrical conductors 20.

Housing structure 12 (e.g., a top, bottom or sidewall of an enclosure for an electrical component) may be composed of any of a variety of weldable thermoplastics, metals, or meal alloys. However, in certain preferred embodiments, housing structure 12 and welding strip 22 are comprised of metals or metal alloys, such as aluminum or an aluminum alloy. Welding strip 22 and housing structure 12 are joined together by a weld joint 24 that extends continuously around connector 16 and sealingly closes the opening defined in metal structure 12. In the illustrated embodiment, electrical conductors 20 are pins designed to engage sockets of an electronic component on the inside of a housing on one side (with the portions extending downwardly from connector 16 in FIG. 1) and a socket connector on the other (top) side of connector 16. However, other types of conductors are envisioned, including electrical wires, socket connections, etc.

In a preferred embodiment, welding strip 22 and housing structure 12 are joined and sealed together with a weld joint 24 that is produced by a friction stir welding technique. In friction stir welding, a tool with a probe attached to its tip is rotated at a high speed while being pushed against the overlapping (or abutting) pieces of metal to be welded. The frictional heat generated by this process softens the metal to produce a plastic flow that effectively stirs the overlapping (or abutting) metal pieces and melts the pieces together to create a weld. Unlike fusion welding, friction stir welding is a solid phase welding method that produces a weld joint having excellent mechanical properties. Friction stir welding has several advantages. First it creates a hermetic seal between the housing component and electrical harness. Further, unlike fusion welding techniques, weld joints having excellent mechanical properties can be achieved between components composed of different metals or metal alloys, or between different thermoplastics. The strong and durable weld joint between welding strip 22 and housing structure 12 eliminates the need for mechanical fasteners such as threaded screws or the like. It also eliminates the need for dispensing adhesives and for curing adhesives, thereby reducing capital equipment and energy costs. Friction stir welding also produces a reliable weld joint that is not susceptible to failure, and which provides improved electromagnetic compatibility. In fact, the high reliability of the weld joint produced by friction stir welding is expected to eliminate the need for leak testing after assembly.

In FIG. 2, there is shown an alternative embodiment, in which welding strip 22 is part of a stamped metal piece that extends all the way through polymeric connector harness 18, but which is provided with apertures 30 to permit conductors 20 to pass through without contacting metal plate 32, and to allow the upper and lower sections of polymeric connector harness 18 to form a unitary mass during molding or other shaping operations. Metal plate 32 provides electromagnetic impulse shielding at a relatively low cost.

Figure 3:
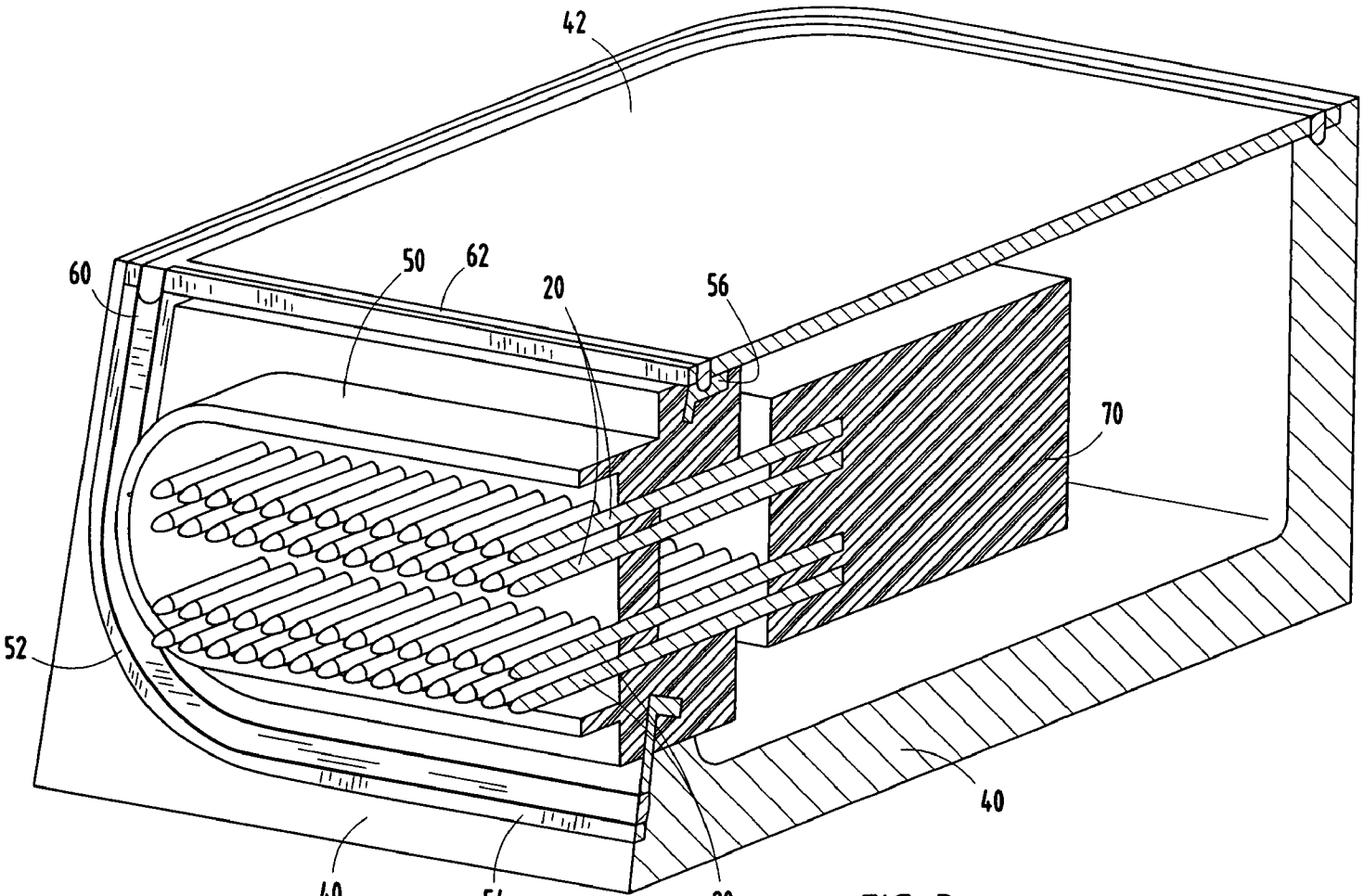
FIG. 3 is a cross-sectional perspective view of an alternative embodiment of the invention in which the welding strip has a section with a flange that extends laterally away from the polymeric electrical connector harness and another section that is embedded flush with a sidewall of the polymeric electrical connector harness.

Shown in FIG. 3 is another example of the invention in which the opening in the housing structure is defined by a metal base housing component 40 and a metal cover housing component 42 that are welded together to define an opening for connector 50. Welding strip 52 includes a flanged section 54 that projects laterally away from polymeric connector harness 50, and another section 56 that is embedded flush with a wall of polymeric connector harness 50. Connector harness 50 is sealingly connected to the housing defined by base 40 and cover 42 by stir friction welding between the flanged section 54 of welding strip 52 and the underlying base housing component 40 along weld joint 60, and by stir friction welding between cover 42 and the flush mounted section 56 of welding strip 52 along weld joint 62. An electrical component 70 is disposed in the housing defined by components 40, 42 and connector 50, and is electrically connected to one or more other electrical devices by conductors 20.

The electrical connectors, assemblies, and processes of this invention have advantages of creating a hermetic seal between a connector and a metal structure, eliminating the need for mechanical fasteners, eliminating the need for dispensing adhesives, reducing capital equipment and energy costs, enhancing product validation testing, and/or eliminating leak testing of components after assembly.

It will be understood by those who practice the invention and those skilled in the art that various modifications and improvements may be made to the invention without departing from the spirit of the disclosed concept. The scope of protection afforded is to be determined by the claims and by the breadth of interpretation allowed by law.

The invention claimed is:

1. An electrical connector including a polymeric electrical connector harness, at least one electrical conductor extending through and sealingly engaged with the electrical connector harness, and a welding strip sealingly connected around a perimeter of the electrical connector harness to facilitate welding of the electrical connector to a housing structure and sealingly closing an opening defined in the housing structure, wherein the welding strip is a stamped metal piece having a central section embedded in the polymeric connector harness, the embedded central section having at least one aperture to allow each electrical conductor to pass through without contacting the central section, the central section being sufficiently coextensive with the area of the polymeric electrical connector harness to provide effective electromagnetic impulse shielding.

2. An assembly comprising:

a housing structure defining an opening sealingly closed with an electrical connector;

at least one electronic device deposed within the housing structure;

the electrical connector including a polymeric connector harness, at least one electrical conductor extending through and sealingly engaged with the polymeric connector harness, and a welding strip sealingly connected to and extending around a perimeter of the polymeric connector harness; and a weld joint between the housing structure and the welding strip, the weld joint extending around the electrical connector to seal the electrical connector in the opening, wherein the welding strip is a stamped metal piece having a central section embedded in the polymeric connector harness, the embedded central section having at least one aperture to allow each electrical conductor to pass through without contacting the central section, the central section being sufficiently coextensive with the area of the polymeric electrical connector harness to provide effective electromagnetic impulse shielding.

3. A process for sealingly attaching an electrical connector to a housing structure comprising:

providing an electrical connector including a polymeric electrical connector harness, at least one electrical conductor extending through the electrical connector harness, and a welding strip sealingly connected around a perimeter of the electrical connector harness to facilitate welding of the electrical connector to a housing structure and sealingly closing an opening defined in the housing structure;

providing a housing structure defining an opening;

positioning the electrical connector at the opening defined in the housing structure so that a surface of the welding strip engages a surface of the housing structure to define a perimeter seam adjacently circumscribing the opening defined in the housing structure; and welding the welding strip to the housing structure along the seam to sealingly attach the electrical connector to the housing structure and sealingly close the opening in the housing structure.

4. The process of claim 3, wherein the housing structure is a housing containing an electronic component electrically connected to the at least one electrical conductor extending through the polymeric connector harness.

5. The process of claim 3, wherein the welding strip and housing structure are welded together using friction stir welding.

6. The process of claim 3, wherein the welding strip is composed of a metal or metal alloy.

7. The process of claim 3, wherein the welding strip has a section embedded within the polymeric connector harness.

8. The process of claim 3, wherein the electrical conductor extending through the polymeric connector harness is a metal pin.

9. The process of claim 3, wherein the welding strip has an upwardly bent inner peripheral lip embedded in the polymeric connector harness.

10. The process of claim 3, wherein the welding strip is a stamped metal piece having a central section embedded in the polymeric connector harness, the embedded central section having at least one aperture to allow each electrical conductor to pass through without contacting the central section, the central section being sufficiently coextensive with the area of the polymeric electrical connector harness to provide effective electromagnetic impulse shielding.

* * * * *